US010280725B2

(12) United States Patent
Jiang

(10) Patent No.: US 10,280,725 B2
(45) Date of Patent: May 7, 2019

(54) HYDRAULIC DOUBLE-ACTING FRACTURING PUMP SKID

(71) Applicant: Huangshan Huirun Machinery Co., Ltd., Huangshan (CN)

(72) Inventor: Jie Jiang, Huangshan (CN)

(73) Assignee: Huangshan Huirun Machinery Co., Ltd., Huangshan (CN)

( * ) Notice: Subject to any disclaimer, the term of this patent is extended or adjusted under 35 U.S.C. 154(b) by 0 days.

(21) Appl. No.: 15/696,243

(22) Filed: Sep. 6, 2017

(65) Prior Publication Data

US 2018/0298739 A1 Oct. 18, 2018

(30) Foreign Application Priority Data

Apr. 18, 2017 (CN) ..... 2017 1 0254283

(51) Int. Cl.
*E21B 43/26* (2006.01)

(52) U.S. Cl.
CPC ..... *E21B 43/26* (2013.01)

(58) Field of Classification Search
CPC ..... E21B 43/26
See application file for complete search history.

(56) References Cited

U.S. PATENT DOCUMENTS 3,332,496 A * 7/1967 Anderson ..... E21B 43/26 166/177.5
2017/0022788 A1* 1/2017 Oehring ..... E21B 41/0021
2018/0266412 A1* 9/2018 Stokkev ..... F04B 11/0058

* cited by examiner

*Primary Examiner* — Matthew R Buck
*Assistant Examiner* — Aaron L Lembo
(74) *Attorney, Agent, or Firm* — Maier & Maier, PLLC

(57) ABSTRACT

The present invention discloses a hydraulic double-acting fracturing pump skid, comprising a skid chassis, power motors, oil pumps, a hydraulic power end and fluid ends; the power motors and the oil pumps are arranged at two ends of the skid chassis, the hydraulic power end is arranged in the middle of the skid chassis, and the fluid ends are arranged on two sides of the hydraulic power end; the power motors are connected to the oil pumps via a transmission mechanism, the oil pumps are communicated with the hydraulic power end via a three-position four-way directional valve and can drive the hydraulic power end to operate, the hydraulic power end is connected to the hydraulic power in a transmission way, and a lower end of the fluid ends is communicated with a low-pressure manifold and two sides of the fluid ends are respectively communicated with a high-pressure manifold. The hydraulic double-acting fracturing pump skid of the present invention has the advantages of small volume, large flow, high pressure, high power and long-term continuous operation.

9 Claims, 2 Drawing Sheets

HYDRAULIC DOUBLE-ACTING FRACTURING PUMP SKID

This application claims priority to Chinese application number 201710254283.6, filed 18 Apr. 2017, with a title of HYDRAULIC DOUBLE-ACTING FRACTURING PUMP SKID. The above-mentioned patent application is incorporated herein by reference in its entirety.

TECHNICAL FIELD

The present invention relates to the technical field of fracturing equipment and in particular to a hydraulic double-acting fracturing pump.

BACKGROUND

Fracturing construction has become a main technical method for the reformation of low permeable oil and gas reservoirs and for the development of unconventional oil and gas reservoirs. As one of effective measures for improving the recovery efficiency of oil and gas wells, fracturing construction is widely applied for increasing the production of oil and gas wells and the injection of water injection wells.

America has led the world in design and manufacturing of fracturing trucks. The manufactured fracturing truck products have the advantages of good performance, high degree of automation, high workload, large displacement and great variety. The fracturing trucks have two main models, i.e., 1490 kw and 1864 kw, with a maximum operating pressure of 160 MPa and a largest displacement of 2.7 $m^3$/min. Since most of oil and gas wells in the North America are in plains, the overall loading capacity, the arrangement of the fracturing pump and the like are not restricted by the road conditions. Fracturing trucks of above 1864 kw are usually trailer-mounted.

In different regions and under different operating conditions, fracturing trucks are widely used for the development of oil and gas wells such as petroleum wells, coal-bed gas wells and shale gas wells in regions including lands, deserts and oceans. The fracturing trucks may be vehicle-mounted fracturing trucks, trailer-mounted fracturing trucks and skid-mounted fracturing trucks. However, due to the complex environment of shale gas reservoirs and the geographic conditions and road conditions of the construction regions in China, the fracturing trucks are required to be highly movable, safe and adaptable, with strict restrictions on their size and weight. High-power fracturing trucks are required to improve the fracturing efficiency and reduce the fracturing cost. A conventional fracturing truck usually comprises a chassis (skid chassis), an on-deck engine, a gearbox, a fracturing pump, a lubrication system, a hydraulic system, a control system, high- and low-pressure manifolds, etc.

The conventional high-power fracturing trucks have the following problems during their operation in the inland regions of China.

The power supply scheme "diesel engine-gearbox-fracturing pump" used in the fracturing trucks has the advantages of high fuel consumption, high noise pollution, high difficulty in matching the engine and the torque converter, poor operating conditions, high operating cost, etc. Furthermore, due to this scheme, the high-power diesel engine and the gearbox have large size and weight, which is disadvantageous for the miniaturized design of the vehicle-mounted scheme. It is hard to effectively solve the problems of remote wells and limited operating space in China. Furthermore, the output power of the conventional fracturing trucks driven by the diesel engine rarely exceeds 2237 kw. This is disadvantageous for the high-power development of the vehicle-mounted scheme. Particularly with higher requirements on "low-carbon green", the effect of high-power diesel engines will be limited. The scheme of driving by the diesel engine will become the bottleneck of the development of fracturing trucks.

With the improvement to the fracturing processes and the large-scale development of unconventional oil and gas wells such as shale gas reservoirs, the fracturing construction puts forward higher requirements on the single-machine power, pressure, displacement, reliability and degree of automation of fracturing trucks. A fracturing truck having a single-machine power of below 1490 kw has already not met the "industrialized" operating requirement, i.e., over ten thousands of cubic meters of liquid and thousands of cubic meters of sand. As the core equipment for fracturing construction, the fracturing device should be designed in small volume, high power, ultrahigh pressure and large displacement.

SUMMARY

An objective of the present invention is to provide a hydraulic double-acting fracturing pump skid which meets the requirements on small volume, large flow, high pressure, high power and long-term fracturing construction, in order to solve the problems in the prior art.

For this purpose, the present invention provides the following technical schemes.

The present invention provides a hydraulic double-acting fracturing pump skid, comprising a skid chassis, power motors, oil pumps, a hydraulic power end and fluid ends; the power motors and the oil pumps are arranged at two ends of the skid chassis, the hydraulic power end is arranged in the middle of the skid chassis, and the fluid ends are arranged on two sides of the hydraulic power end; the power motors are connected to the oil pumps via a transmission mechanism, the oil pumps are communicated with the hydraulic power end via a three-position four-way directional valve and can drive the hydraulic power end to operate, the hydraulic power end is connected to the hydraulic power in a transmission way, and a lower end of the fluid ends is communicated with a low-pressure manifold and two sides of the fluid ends are respectively communicated with a high-pressure manifold.

Further, the oil pumps are communicated with a port P of the three-position four-way directional valve via a pipeline, and a port T of the three-position four-way directional valve is communicated successively with a filter, an oil cooler and an oil tank via a pipeline.

Further, the hydraulic power end comprises two groups of execution units, each group comprising two double-rod cylinder pistons; a chamber at one end of each of the two double-rod cylinder pistons is communicated with a chamber at one end of the other double-rod cylinder piston via a pipeline, and a chamber at the other end of the double-rod cylinder piston is communicated with a port A and a port B of the three-position four-way directional valve via a pipeline; a piston rod of each of the double-rod cylinder pistons is connected to a plunger of the fluid end via a coupling; and suction valves of the fluid end are connected in parallel via the low-pressure manifold and discharge valves of the fluid end are connected in parallel via the high-pressure manifold.

Further, the hydraulic double-acting fracturing pump further comprises a liquid filling loop which is communicated with a pipeline between the two double-rod cylinder pistons via a pipeline, with an electronic ball valve being provided in a pipeline between the liquid filling loop and the double-rod cylinder pistons.

Further, the port P of each of the three-position four-way directional valves is connected with two of the oil pumps in parallel, and each oil pump is connected to one of the power motors via a transmission mechanism.

Further, a check valve and a proportional relief valve are provided in a pipeline between the oil pumps and the port P of the three-position four-way directional valve.

Further, a thermometer, a piezometer and a pressure transmitter are provided in a pipeline between the oil pumps and the port P of the three-position four-way directional valve.

Further, the oil pumps are axial proportional variable displacement plunger pumps, and the power motors are AC asynchronous motors.

Further, the hydraulic double-acting fracturing pump skid further comprises a cooling system for cooling the hydraulic power end and the fluid ends.

Further, the hydraulic double-acting fracturing pump skid further comprises a lubrication system for lubricating the hydraulic power end and the fluid ends.

The hydraulic double-acting fracturing pump skid of the present invention has the following operating principle. The oil pumps are driven by the power motors to operate; the high-pressure oil is pumped by the oil pumps into the hydraulic power end through the three-position four-way directional valve; under the control of the three-position four-way directional valve, the hydraulic power end drives the fluid ends to do reciprocating motion; and the operating cavity of the fluid ends alternately changes between positive pressure and negative pressure. In this way, the pumping of the fluid medium is completed.

Compared with the prior art, the present invention has the following technical effects.

With regard to the hydraulic double-acting fracturing pump skid of the present invention, power motors are used to drive the oil pumps. Compared with the conventional diesel engine and gearbox power system, the volume is greatly reduced. Due to the reduced volume of the hydraulic double-acting fracturing pump skid, the transportation convenience and flexibility are significantly improved.

In the present invention, the hydraulic power end comprises two groups of execution units, each group comprising two double-rod cylinder pistons. The pumping of the fluid medium is implemented by driving eight fluid cylinders at the fluid ends by four double-rod cylinder pistons. This greatly increases the displacement of the hydraulic double-acting fracturing pump skid of the present invention.

In the present invention, each three-position four-way directional valve is connected with two oil pumps in parallel. Therefore, there are total four oil pumps operating at the same time, and each oil pump is driven by one power motor. This greatly increases the power of the hydraulic double-acting fracturing pump skid.

In the present invention, a cooling system and a lubrication system are additionally provided, so that the hydraulic power end and the fluid ends are always kept in the stable operating state. Thus, long-term continuous operation can be realized.

BRIEF DESCRIPTION OF THE DRAWING

To describe the technical solutions of the embodiments of the present invention or in the prior art more clearly, drawings to be used for the description of the embodiments will be briefly introduced below. Apparently, the drawings to be described below are merely some embodiments of the present invention. Other drawings may be obtained by a person of ordinary skill in the art according to those drawings without paying any creative effort.

FIG. 2 is a structure diagram of the hydraulic double-acting fracturing pump skid according to the present invention, in which:

1: skid chassis;
2: oil pump;
3: power motor;
4: low-pressure manifold;
5: high-pressure manifold;
6: fluid end;
7: hydraulic power end;
8: oil tank;
9: oil cooler;
10: cooling system;
11: lubrication system;
12: electric control system;
13: check valve;
14: proportional relief valve;
15: thermometer;
16: piezometer;
17: pressure transmitter;
18: filter;
19: three-position four-way directional valve;
20: liquid filling loop;
21: electronic ball valve;
E: double-rod cylinder piston E;
F: double-rod cylinder piston F;
H: double-rod cylinder piston H;
K: double-rod cylinder piston K;
I: fluid cylinder I;
II: fluid cylinder II;
III: fluid cylinder III;
IV: fluid cylinder IV;
V: fluid cylinder V;
VI: fluid cylinder VI;
VII: fluid cylinder VII; and
VIII: fluid cylinder VIII.

DETAILED DESCRIPTION

The technical solutions in the embodiments of the present invention will be described clearly and completely below with reference to the drawings in the embodiments of the present invention. Obviously, the described embodiments are merely some but not all of the embodiments of the present invention. All other embodiments obtained by a person of ordinary skill in the art on the basis of the embodiments of the present invention without paying any creative effort shall be included within the protection scope of the present invention.

An objective of the present invention is to provide a hydraulic double-acting fracturing pump skid which meets the requirements on small volume, large flow, high pressure, high power and long-term fracturing construction, in order to solve the problems in the prior art.

To make the objectives, features and advantages of the present invention clearer, the present invention will be further described in detail by specific implementations with reference to the accompanying drawings.

Figure 1:
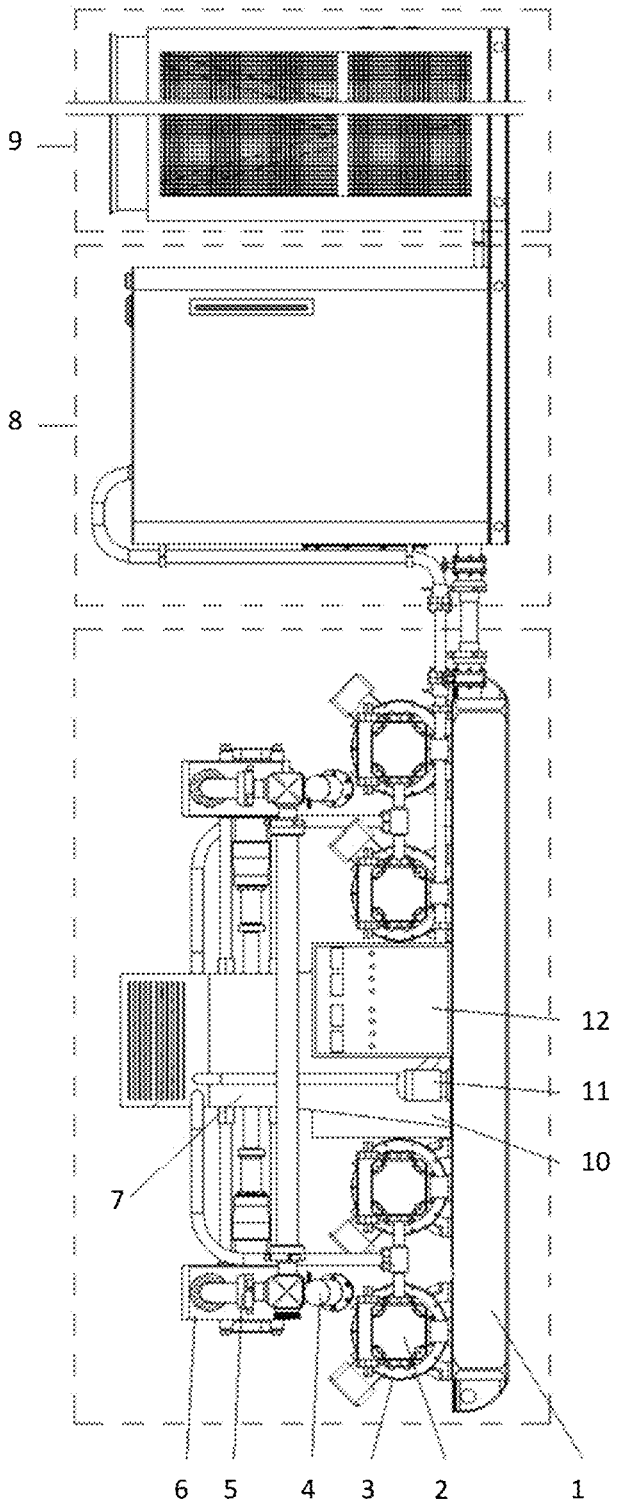
FIG. 1 is a structure diagram of the hydraulic double-acting fracturing pump skid according to the present invention.
Figure 2:
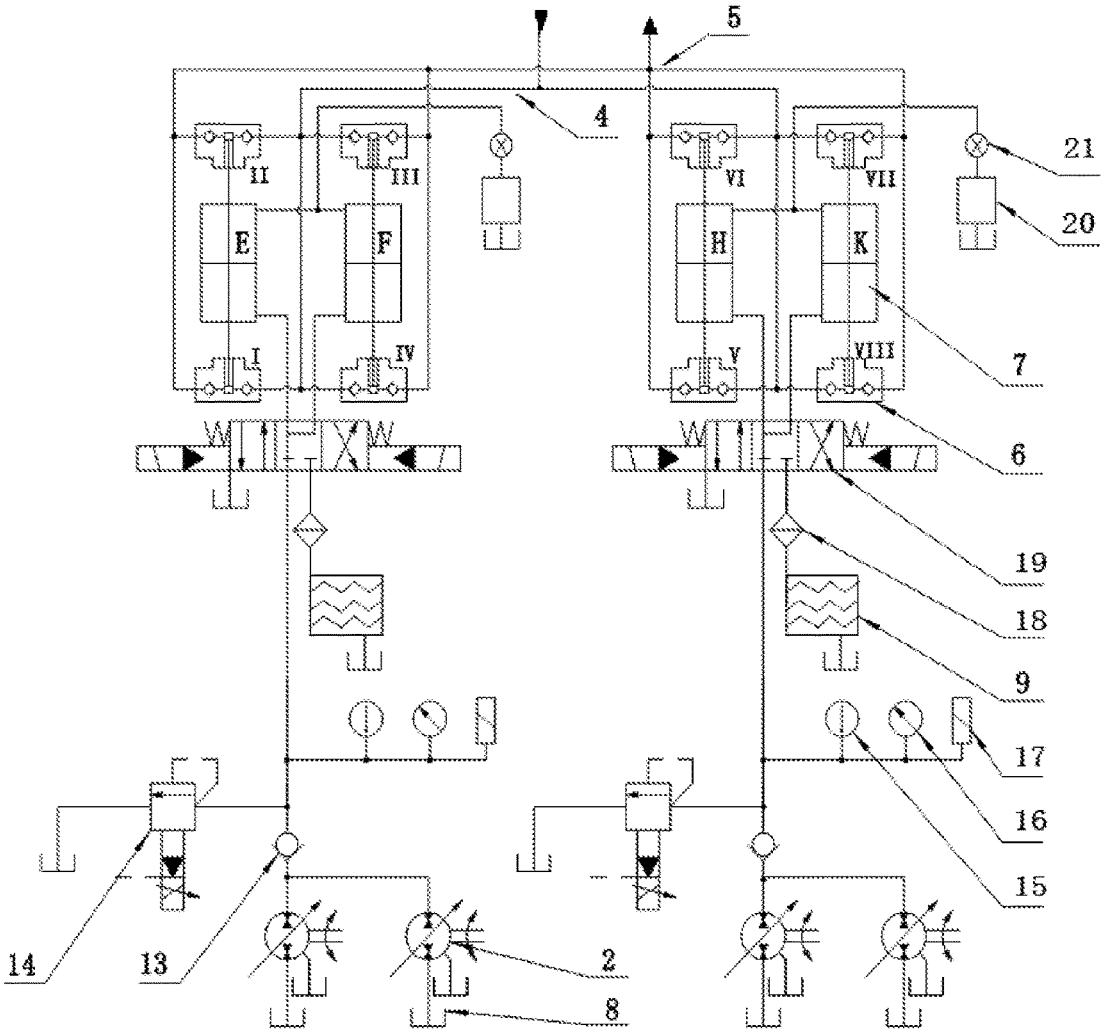

Referring to FIG. 1 and FIG. 2, this embodiment provides a hydraulic double-acting fracturing pump skid, comprising a skid chassis 1, four power motors 3, four oil pumps, a hydraulic power end 7, fluid ends 6, a cooling system 10, a lubrication system 11 and an electric control system 12. The power motors 3 are preferably AC asynchronous motors, and the oil pumps 2 are preferably axial proportional variable displacement plunger pumps.

The four power motors 3 and the four oil pumps 2 are laterally symmetrically arranged at the two ends of the skid chassis 1, the hydraulic power end 7 is arranged in the middle of the skid chassis 1, and the fluid ends 6 are preferably two four-cylinder fluid ends. Each power motor 3 is connected to an oil pump 2 via a transmission mechanism, and the oil pumps 2 are pairwise connected in parallel and then communicated with the hydraulic power end 7 via a three-position four-way directional valve 19. The two fluid ends 6 are connected to the hydraulic power end 7 in a transmission way, respectively. The lower end of the fluid ends 6 is communicated with the low-pressure manifold 4, and the two sides of the fluid ends 6 are communicated with the high-pressure manifold 5, respectively. The power motors 3 drive the oil pumps 2 to operate. The oil pumps 2 drive the hydraulic power end 7 to operate and thus drive the fluid ends 6 to complete the pumping of the fluid medium.

Two oil pumps 2 are connected in parallel and then communicated with the port P of the three-position four-way directional valve 19 via a pipeline. The port T of the three-position four-way directional valve 19 is successively communicated with a filter 18, an oil cooler 9 and an oil tank 8 via a pipeline. The oil tank 8 is connected with the skid chassis 1, and the oil cooler 9 is communicated with the oil tank 8. The hydraulic oil inside the oil tank 8 is cooled by forcedly circulating the oil. A check valve 13, a proportional relief valve 14, a thermometer 14, a piezometer 15 and a pressure transmitter 17 are further provided in a pipeline between the oil pumps 2 and the port P of the three-position four-way directional valve 19.

The hydraulic power end 7 comprises two groups of execution units, each group comprising two double-rod cylinder pistons. A chamber at one end of each of the two double-rod cylinder pistons is communicated with a chamber at one end of the other double-rod cylinder piston via a pipeline which is also communicated with a liquid filling loop 20. The liquid filling loop 20 is used for supplementing oil to the double-rod cylinder pistons. An electronic ball valve 21 is provided in a pipeline between the liquid filling loop 20 and the double-rod cylinder pistons.

A chamber at the other end of each of the two double-rod cylinder pistons is communicated with a port A and a port B of the three-position four-way directional valve 19 via a pipeline; a piston rod of each of the double-rod cylinder pistons is connected to a plunger of a fluid end 6 via a coupling; and suction valves of the fluid end 6 are connected in parallel via the low-pressure manifold 4 and discharge valves of the fluid end are connected in parallel via the high-pressure manifold 5.

The cooling system 10 is used for cooling the hydraulic power end 7 and the fluid ends 6. The lubrication system 11 is used for lubricating the hydraulic power end 7 and the fluid ends 6. The power motors 3, the proportional relief valve 14, the thermometer 15, the piezometer 16, the pressure transmitter 17 and the three-position four-way directional valve 19 are electrically connected to the electric control system 12.

Referring to FIG. 2, the hydraulic double-acting fracturing pump skid of the present invention has the following operating principle.

The electric control system 12 controls the power motors 3 to operate; the power motors 3 drive the oil pumps 2 to operate; high-pressure oil is pumped by the oil pumps 2 and flows to the three-position four-way directional valve 19 through the check valve 13; and the electric control system 12 keeps the spool of the three-position four-way directional valve 19 on the left side. Now, the double-rod cylinder piston E and the double-rod cylinder piston H of the hydraulic power end 7 are charged with high pressure; the piston rods of the double-rod cylinder piston E and the double-rod cylinder piston H move upward, and the piston rods of the double-rod cylinder piston F and the double-rod cylinder piston K move downward; the fluid medium inside the fluid cylinder II, the fluid cylinder IV, the fluid cylinder VI and the fluid cylinder VIII is compressed and then discharged, in form of high-pressure fluid, along the high-pressure manifold 5 through the discharge valves. Meanwhile, the volume cavities of the fluid cylinder I, the fluid cylinder III, the fluid cylinder V and the fluid cylinder VII are in negative pressure so that the fluid medium is sucked therein along the low-pressure manifold 4 through the suction valves. When the piston rod of the hydraulic power end 7 approaches the left limit position, i.e., when the piston rods of the double-rod cylinder piston E and the double-rod cylinder piston H approach the upper limit position and the piston rods of the double-rod cylinder piston F and the double-rod cylinder piston K approach the lower limit position, the electric control system 12 controls the directional switchover of the spool of the three-position four-way directional valve 19 so that the spool is on the right side. Now, the double-rod cylinder piston F and the double-rod cylinder piston K of the hydraulic power end 7 are charged with high pressure; the piston rods of the double-rod cylinder piston F and the double-rod cylinder piston K move upward, and the piston rods of the double-rod cylinder piston E and the double-rod cylinder piston H move downward; the fluid medium inside the fluid cylinder I, the fluid cylinder III, the fluid cylinder V and the fluid cylinder VII is compressed and then discharged, in form of high-pressure fluid, along the high-pressure manifold 5 through the discharge valves. Meanwhile, the volume cavities of the fluid cylinder II, the fluid cylinder IV, the fluid cylinder VI and the fluid cylinder VIII are in negative pressure so that the fluid medium is sucked therein along the low-pressure manifold 4 through the suction valves. By such repeated operations, the fluid ends 6 complete the pressurization and conveying of the fluid medium.

With regard to the hydraulic double-acting fracturing pump skid of the present invention, power motors 3 are used to drive the oil pumps 2. Compared with the conventional diesel engine and gearbox power system, the volume is greatly reduced. Due to the reduced volume of the hydraulic double-acting fracturing pump skid, the transportation convenience and flexibility are significantly improved. The problems of large fracturing trucks are solved, such as, difficulty in getting license, difficulty in getting approval of driving, and difficulty in driving up the hill.

In this embodiment, the hydraulic power end 7 comprises two groups of execution units, each group comprising two double-rod cylinder pistons. The pumping of the fluid medium is implemented by driving eight fluid cylinders at the fluid ends 6 by four double-rod cylinder pistons. This greatly increases the displacement of the hydraulic double-acting fracturing pump skid of the present invention. In this embodiment, the hydraulic double-acting fracturing pump skid can have a maximum displacement of 7.15 $m^3$/min and a highest operating pressure of 140 MPa.

In this embodiment, each three-position four-way directional valve 19 is connected with two oil pumps 2 in parallel. Therefore, there are total four oil pumps 2 operating at the same time, and each oil pump 2 is driven by one power motor 3. This greatly increases the single-machine power of the hydraulic double-acting fracturing pump skid. The hydraulic double-acting fracturing pump skid in this embodiment can have an output power of 4500 kw.

In this embodiment, a cooling system 10 and a lubrication system 11 are additionally provided, so that the hydraulic power end 7 and the fluid ends 6 are always kept in the stable operating state. Thus, long-term continuous operation can be realized.

The principle and implementations of the present invention have been described by specific examples herein. The description of embodiments is merely used for helping the understanding of the method of the present invention and its key concepts. Meanwhile, for a person of ordinary skill in the art, changes may be made to the specific implementations and application ranges according to the concepts of the present invention. In conclusion, the contents of the description should not be considered as any limitation to the present invention.

What is claimed is:

1. A hydraulic double-acting fracturing pump skid, comprising a skid chassis, power motors, oil pumps, a hydraulic power end and fluid ends;

the power motors and the oil pumps are arranged at two ends of the skid chassis, the hydraulic power end is arranged in the middle of the skid chassis, and the fluid ends are arranged on two sides of the hydraulic power end; the power motors are connected to the oil pumps via a transmission mechanism, the oil pumps are communicated with the hydraulic power end via a three-position four-way directional valve and can drive the hydraulic power end to operate, the hydraulic power end is connected to the hydraulic power via a transmission mechanism, and a lower end of the fluid ends is communicated with a low-pressure manifold and two sides of the fluid ends are respectively communicated with a high-pressure manifold;

a source of fluid is connected with the low-pressure manifold;

the hydraulic power end comprises two groups of execution units, each group comprising two double-rod cylinder pistons; a chamber at one end of each of the two double-rod cylinder pistons is communicated with a chamber at one end of the other double-rod cylinder piston via a pipeline, and a chamber at the other end of the double-rod cylinder piston is communicated with a port A and a port B of the three-position four-way directional valve via a pipeline; a piston rod of each of the double-rod cylinder pistons is connected to a plunger of the fluid end via a coupling; and suction valves of the fluid end are connected in parallel via the low-pressure manifold and discharge valves of the fluid end are connected in parallel via the high-pressure manifold.

2. The hydraulic double-acting fracturing pump skid according to claim 1, characterized in that the oil pumps are communicated with a port P of the three-position four-way directional valve via a pipeline, and a port T of the three-position four-way directional valve is communicated successively with a filter, an oil cooler and an oil tank via a pipeline.

3. The hydraulic double-acting fracturing pump skid according to claim 1, further comprising a liquid filling loop which is communicated with a pipeline between the two double-rod cylinder pistons via a pipeline, with an electronic ball valve being provided in a pipeline between the liquid filling loop and the double-rod cylinder pistons.

4. The hydraulic double-acting fracturing pump skid according to claim 1, characterized in that the port P of each of the three-position four-way directional valves is connected with two of the oil pumps in parallel, and each oil pump is connected to one of the power motors via a transmission mechanism.

5. The hydraulic double-acting fracturing pump skid according to claim 2, characterized in that a check valve and a proportional relief valve are provided in a pipeline between the oil pumps and the port P of the three-position four-way directional valve.

6. The hydraulic double-acting fracturing pump skid according to claim 2, characterized in that a thermometer, a piezometer and a pressure transmitter are provided in a pipeline between the oil pumps and the port P of the three-position four-way directional valve.

7. The hydraulic double-acting fracturing pump skid according to claim 1, characterized in that the oil pumps are an axial proportional variable displacement plunger pumps, and the power motors are AC asynchronous motors.

8. The hydraulic double-acting fracturing pump skid according to claim 1, further comprising a cooling system for cooling the hydraulic power end and the fluid ends.

9. The hydraulic double-acting fracturing pump skid according to claim 1, further comprising a lubrication system for lubricating the hydraulic power end and the fluid ends.

* * * * *